US009932815B2

(12) United States Patent
Flight et al.

(10) Patent No.: US 9,932,815 B2
(45) Date of Patent: Apr. 3, 2018

(54) MONITORING TUBING RELATED EQUIPMENT

(71) Applicant: Schlumberger Technology Corporation, Sugar Land, TX (US)

(72) Inventors: Kirk Flight, Spring, TX (US); John Yarnold, League City, TX (US); Matthew Niemeyer, League City, TX (US); Jeffrey Marabella, Friendswood, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/958,231

(22) Filed: Dec. 3, 2015

(65) Prior Publication Data

US 2016/0160630 A1 Jun. 9, 2016

Related U.S. Application Data

(60) Provisional application No. 62/088,376, filed on Dec. 5, 2014.

(51) Int. Cl.
*E21B 17/01* (2006.01)
*E21B 47/00* (2012.01)

(52) U.S. Cl.
CPC ..... *E21B 47/0006* (2013.01); *E21B 17/01* (2013.01); *E21B 47/0001* (2013.01)

(58) Field of Classification Search
CPC .... E21B 17/01; E21B 34/045; E21B 47/0001; E21B 47/0006
USPC ..... 166/336
See application file for complete search history.

(56) References Cited

U.S. PATENT DOCUMENTS 3,855,853 A * 12/1974 Claycomb ..... E21B 47/0006 175/40
3,855,857 A * 12/1974 Claycomb ..... E21B 47/0006 73/152.59
4,174,628 A * 11/1979 van den Bussche ... B63B 21/50 405/195.1
4,805,449 A * 2/1989 Das ..... E21B 21/08 175/48
6,725,924 B2 * 4/2004 Davidson ..... E21B 41/0014 166/250.01

(Continued)

FOREIGN PATENT DOCUMENTS

WO 2013109573 A1 7/2013

OTHER PUBLICATIONS

PCT/US2015/063925—International Search Report and Written Opinion, dated Feb. 23, 2016, 13 pgs.

*Primary Examiner* — Matthew R Buck
(74) *Attorney, Agent, or Firm* — Rodney Warfford

(57) ABSTRACT

A technique facilitates monitoring of strain related effects along a tubing string, such as a tubing string extending from surface equipment toward a sea floor in a subsea well application. A monitoring module is employed to monitor the strain related effects and may have a tubular structure. The monitoring module also has a reduced wall thickness region constructed to concentrate strain in this reduced wall thickness region. Additionally, the monitoring module comprises at least one sensor mounted to the tubular structure in the reduced wall thickness region for monitoring of strains.

14 Claims, 3 Drawing Sheets

(56) References Cited

U.S. PATENT DOCUMENTS

| | | | | |
|---|---|---|---|---|
| 6,802,215 | B1 * | 10/2004 | Boucher | E21B 44/00 73/152.48 |
| 7,721,611 | B2 * | 5/2010 | Salama | E21B 17/01 73/862.627 |
| 7,757,759 | B2 * | 7/2010 | Jahn | E21B 19/166 166/250.01 |
| 8,540,030 | B2 | 9/2013 | Radi | |
| 8,708,052 | B2 | 4/2014 | Radi | |
| 8,800,665 | B2 | 8/2014 | Phadke | |
| 9,004,174 | B2 * | 4/2015 | Mebarkia | E21B 41/0085 166/247 |
| 2005/0081618 | A1 | 4/2005 | Boucher et al. | |
| 2005/0100414 | A1 | 5/2005 | Salama | |
| 2008/0202810 | A1 * | 8/2008 | Gomez | E21B 47/011 175/40 |
| 2009/0071645 | A1 * | 3/2009 | Kenison | E21B 44/00 166/250.01 |
| 2011/0016964 | A1 | 1/2011 | Strom | |
| 2011/0259115 | A1 * | 10/2011 | Roberts | G01M 5/0025 73/800 |
| 2012/0024052 | A1 | 2/2012 | Eriksen | |
| 2012/0325010 | A1 * | 12/2012 | Zeineddine | E21B 47/011 73/855 |
| 2014/0013837 | A1 * | 1/2014 | Lee | G01L 5/0004 73/152.59 |
| 2014/0082304 | A1 | 3/2014 | Clarke | |
| 2014/0116715 | A1 | 5/2014 | Sipila et al. | |
| 2014/0174752 | A1 * | 6/2014 | Sipila | E21B 47/0006 166/336 |
| 2014/0246201 | A1 | 9/2014 | Campello et al. | |

* cited by examiner

MONITORING TUBING RELATED EQUIPMENT

CROSS-REFERENCE TO RELATED APPLICATION

The present document is based on and claims priority to U.S. Provisional Application Ser. No. 62/088,376, filed Dec. 5, 2014, which is incorporated herein by reference in its entirety.

BACKGROUND

In subsea hydrocarbon well applications, production tubing may be used in a subsea well for communicating produced well fluids from subterranean formations to equipment at the sea floor. Completing a subsea well and installing the production tubing includes lowering production tubing into a marine riser string that extends from a surface platform (e.g. a surface vessel) down to the subsea equipment (e.g. a well tree, a blowout preventer (BOP), and/or other subsea equipment) that defines the sea floor entry point of the well. The marine riser string forms protection for the production tubing and other equipment which is lowered into the subsea well from the platform.

At the sea surface, the top end of the production tubing is connected to (e.g. threaded to) a tubing hanger that follows the production tubing down through the marine riser string. A tubing hanger running tool is connected between the tubing hanger and a landing string, and the landing string is lowered down the marine riser string to position the tubing hanger running tool, tubing hanger, and production tubing in the well so that the tubing hanger lands in, or becomes seated in, the subsea well head. The tubing hanger running tool is hydraulically or mechanically activated to set the tubing hanger in the well tree. The setting of the tubing hanger locks it to the well tree. The tubing hanger running tool may then be remotely unlatched from the tubing hanger and retrieved with the landing string from the platform.

SUMMARY

In general, a system and methodology are provided for monitoring strain related effects along a tubing string, such as a tubing string extending from surface equipment toward a sea floor in a subsea well application. A monitoring module is employed to monitor the strain related effects and may have a tubular structure. The monitoring module also has a reduced wall thickness region constructed to concentrate strain in this reduced wall thickness region. Additionally, the monitoring module comprises at least one sensor mounted to the tubular structure in the reduced wall thickness region for monitoring of strains.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
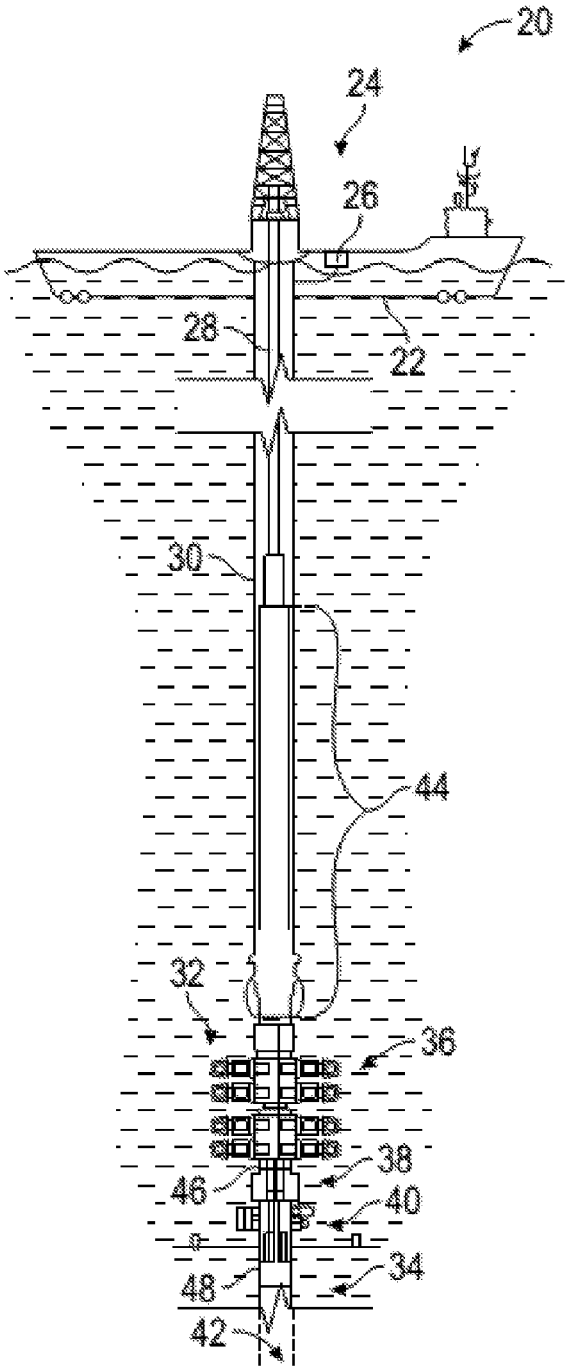
FIG. 1 is a schematic illustration of an example of a subsea well system comprising a tubing string, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology for monitoring strain related effects along a tubing string, such as a tubing string extending from surface equipment toward a sea floor in a subsea well application. Depending on the application, the tubing string may comprise a subsea landing string, a completion string, and/or various other tubing strings and tubing string related devices. A monitoring module having, for example, a tubular structure may be deployed along the tubing string to monitor strain related effects.

According to an embodiment, the monitoring module has a reduced wall thickness region constructed to concentrate strain in this reduced wall thickness region. By way of example, the reduced wall thickness region may be formed along a reduced radius section of the monitoring module. Additionally, the monitoring module comprises at least one sensor mounted to the tubular structure in the reduced wall thickness region for monitoring of strains. As described in greater detail below, the strain data may be used to monitor internal pressure and/or external pressure, to monitor tensile or compressive loading, to monitor torque loading, to predict a fatigue life of a component based on the loading, to compensate for temperature changes, to facilitate error determination, and/or to monitor other loading or environmentally related factors.

Embodiments described herein may comprise devices for landing string and completion string monitoring. The devices may be located within the riser and used in conjunction with subsea test trees and their control systems, tubing hanger running tool, and downhole valves and monitoring equipment. Active load, pressure, and temperature sensing, for example, within the landing string provides information that may be helpful during operations. Additionally, time referenced load information within the landing string may aid service providers in determining remaining service life of components subjected to stress and loading conditions. It should be noted the monitoring module also may be used with a variety of other tubing strings, including testing strings, completion strings, and other types of well strings. The monitoring module also can be used along tubing within a subsea wellbore below the subsea test tree.

As the industry moves into deeper waters, the in-riser landing string and completion string are growing in length. Consequently, questions arise with respect to simple topside operations applied to subsea hardware as to whether the subsea equipment received the proper loads to perform an operation. Examples of simple loads for performing an operation may include: loads for landing out the landing/completion string at the mudline, loads related to unlatching the landing/completion string at the mudline, completion tool loads related to receiving appropriate pressure pulses for valve operation, and loading providing a hydrate indicator in the bore of the landing and completion strings.

By incorporating a landing string monitoring module above the tubing hanger, mudline loads can be confirmed. Incorporating a completion string module, or multiple modules below the tubing hanger can be used to monitor the loading and thus to confirm that appropriate signals/operations have been given to the completion/well testing equipment.

The well string monitoring can be performed using multiple monitoring packages either mounted to tubing or through integral bore subs. By way of example, the monitoring package can facilitate: bore pressure and temperature monitoring, annulus pressure and temperature monitoring, use of torque and tensioning gauges for monitoring landing and completion string loads and fatigue monitoring, bending load monitoring, depth measurement/inclinometer, integral visualization, and hydrate monitoring.

Referring generally to FIG. 1, an example of a subsea well system 20 is illustrated as including a sea surface platform 22, e.g. a surface vessel (as shown) or a fixed platform. The surface platform 22 comprises a control system 24 that includes appropriate circuitry 26. For example, the control system 24 may comprise a computer, telemetry circuitry, and/or other components for communicating with subsea circuitry to facilitate monitoring and managing of subsea operations, e.g. deployment of completion equipment into a subsea well. In some embodiments, the control system 24 may be used to communicate with landing string circuitry that is positioned near the lower, remote end of a landing string 28. The communication may be for purposes such as monitoring and managing the deployment of a tubing hanger and production tubing inside the subsea well.

In some embodiments, the subsea well system 20 comprises a marine riser 30 which extends downwardly from the platform 22 to sea floor equipment 32 which provides the entry point of a subsea well 34. In some embodiments, the lower subsea end of the marine riser 30 connects to a blowout preventer (BOP) 36 that, in turn, is connected to a subsea well tree 38, e.g. a horizontal well tree. The subsea well tree 38 may be connected to a well head 40 positioned above a wellbore 42 of the subsea well 34.

The marine riser string 30 may be used to provide protection from the surrounding sea environment. For example, the marine riser string 30 may be used to protect a tubing string, e.g. the subsea landing string 28, when the landing string 28 is run through the marine riser 30 from the platform 22 and into the subsea well 34. In this manner, the protected landing string 28 may be freely run through the marine riser 30 to facilitate installation of completion equipment, e.g. a tubing hanger and a production tubing, in the subsea well 34.

Additionally, the landing string 28 may include a tool/module assembly 44 which is located at the lower remote end of the landing string 28. In the example illustrated in FIG. 1, the assembly 44 is located just above the BOP 36. As shown, the assembly 44 may have a slightly larger outer diameter than the rest of the landing string 28. For example, the outer diameter of the assembly 44 may approach the inner diameters of the BOP 36 and well tree 38. Depending on the application, the subsea well system 20 also may comprise one or more monitoring modules, such as at least one landing string monitoring module 46 and/or at least one completions monitoring module 48, as described in greater detail below. However, the monitoring module(s) 46/48 can be used with other types of tubing strings and applications, including tubing string applications in wellbore 42 below sea floor equipment 32.

Figure 2:
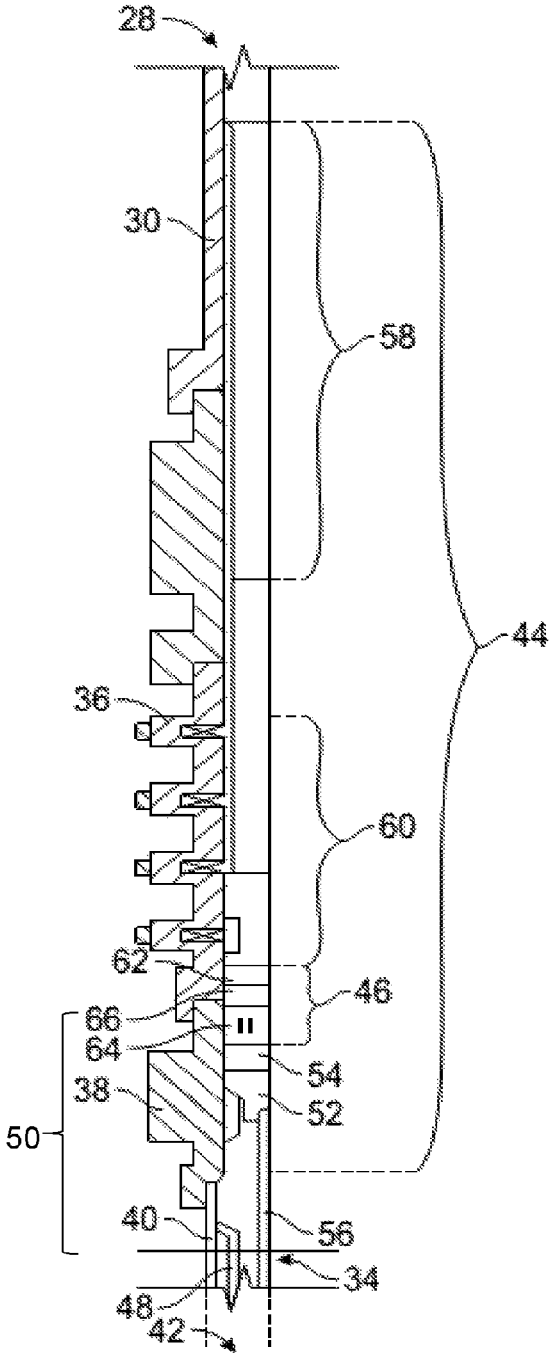
FIG. 2 is a schematic illustration of an example of a remote end segment of a landing string including a monitoring module, according to an embodiment of the disclosure.

Referring generally to FIG. 2, an embodiment of a portion of the landing string 28 is illustrated as received in subsea well equipment 32. FIG. 2 does not show a full cross-sectional view of tubular members 50, e.g. a tubing hanger 52 and the well head 38, but instead shows the left side cross-section. It should be understood that the right side cross-section may be obtained by rotating the left side cross-section about the axis of symmetry. In some applications, the tubular members 50 may form a completions string, part of a completion string, or another tubing string.

In some embodiments, the assembly 44 comprises a tubing hanger running tool 54 that, as its name implies, may be used to set tubing hanger 52. The tubing hanger 52, in turn, rests in the well tree 38 and grips the well tree 38 when set by the tubing hanger running tool 54. The tubular members 50 also may comprise a production tubing 56 which is illustrated as attached to, e.g. threaded into, the tubing hanger 52 while extending below the tubing hanger 52, as also depicted in FIG. 1.

In addition to the tubing hanger running tool 54, the assembly 44 may comprise other tools that are related to monitoring and management of the deployment of the completion equipment. For example, in some embodiments the assembly 44 comprises a module 58 which contains tools such as valves and a latch to control the connection and disconnection of the marine riser 30 and landing string 28 to/from the BOP 36. These tools provide potential emergency disconnection of the landing string 28 from the BOP 36 while also preventing well fluid from flowing from the well or the landing string 28 during the disconnection and connection of the landing string 28 from/to the BOP 36. In some applications, the assembly 44 also may include other tools, such as a test module 60. By way of example, the test module 60 may be used to perform pressure tests in the subsea well 34.

Depending on the application, the landing string 28 may comprise various features permitting remote monitoring and managing of the deployment of the completion equipment. In some embodiments, the assembly 44 of the landing string 28 may comprise at least one of the string monitoring modules 46. The monitoring module 46 may be positioned at a variety of locations along the landing string 28 to monitor selected conditions, e.g. loading conditions. In some embodiments, the monitoring module 46 may be positioned below the subsea test tree and BOP stack, but above the mud line and/or tubing hanger. For some applications, the monitoring module 46 may be employed to confirm and/or measure mudline loads.

The module 46 may include a communication telemetry circuit 62 that communicates with the platform 22 to provide, for example, indications of various parameters and conditions that are sensed by sensors 64, e.g. strain sensors, positioned on the landing string 28. By way of example, the communication telemetry circuit 62 may communicate data signals to the control system 24 at platform 22 via an umbilical cord, wireless communication medium, or other suitable technique. As illustrated in FIG. 2, the sensors 64 may be part of the monitoring module 46 (and/or module 48). In some embodiments, however, sensors 64 may be located in other parts of the landing string 28, as well as being located along other tubular components in the well tree and other parts of the subsea well.

In the embodiment illustrated, the sensors 64 are located near the remote, subsea end of the landing string 28. Thus, the sensors 64 may provide electrical indications of various parameters and conditions, as sensed near this downhole or distal end of the landing string 28. The ability to remotely sense desired parameters and conditions enables better monitoring and management of the deployment and/or operation of subsea completion equipment.

In some embodiments, the monitoring module 46 also may comprise a processor 66 in communication with the sensors 64 to obtain data on the various parameters and conditions that are detected/monitored by these sensors 64. A memory and/or data storage member also may be provided in communication with the processor 66. In some applications, the processor 66 is employed to at least partially process the data provided by one or more sensors 64 before interacting with the telemetry circuit 62 to communicate the processed information to the platform 22. The processor 66 interacts with the telemetry circuit 62 to communicate the various data related to the sensed parameters and conditions to the surface circuitry 26 at platform 22. It should be appreciated that, in some embodiments, raw data from the sensors 64 may be communicated to the surface.

Additionally, the monitoring module 48, e.g. completions monitoring module, may be utilized in a variety of applications. The monitoring module 48 may be constructed similarly to that of monitoring module 46 and may be positioned below the mudline and/or the tubing hanger 52. The monitoring module 48 may be used to confirm and/or monitor operations related to deployment and/or operation of completions and well testing equipment. It should be appreciated that one or more monitoring modules 48 may be implemented alone or in conjunction with one or more landing string monitoring modules 46.

The monitoring module 48 may generally include similar components, parts, and features as the landing string monitoring module 46. For the sake of simplicity, the following discussion may refer to the landing string monitoring module 46 alone. However, it should be appreciated that the following description and accompanying drawings are applicable to the monitoring module 48 as well as the landing string monitoring module 46.

Figure 3:
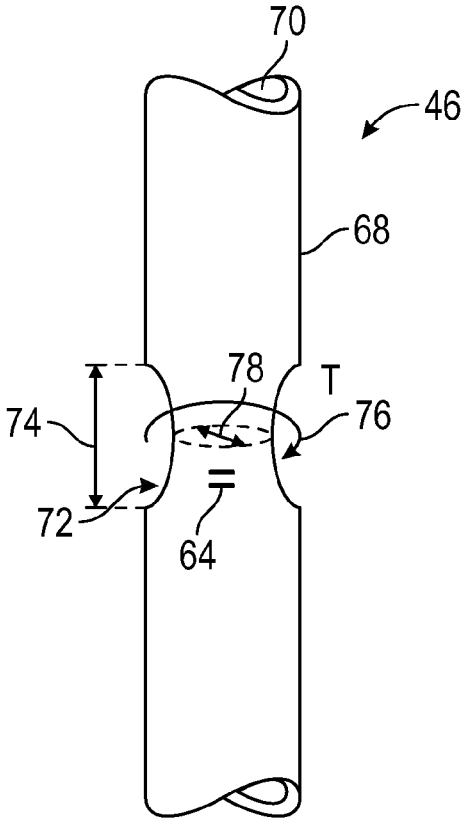
FIG. 3 is a schematic illustration of an example of a monitoring module illustrating strain loading which may act on the monitoring module, according to an embodiment of the disclosure.

Referring initially to FIG. 3, a schematic illustration of an embodiment of monitoring module 46 (or monitoring module 48) is illustrated with examples of the type of strain which may be monitored at module 46. In this example, the monitoring module 46 is generally in the form of a hollow mandrel 68 having an internal passage 70 extending axially therethrough. The monitoring module 46 further comprises a reduced wall thickness region 72 which may be formed in the hollow mandrel 68 so as to encircle the hollow mandrel 68. The reduced wall thickness region 72 serves to concentrate strain for measurement by sensors 64 by focusing or concentrating the forces acting on monitoring module 46 in this particular region. In various embodiments, the sensors 64 are affixed to the surface of the hollow mandrel 68 at the reduced wall thickness region 72. As a result, the strains acting on and concentrated at reduced wall thickness region 72 provide increased sensitivity and resolution with respect to data collected by sensors 64.

Depending on the application, the sensor or sensors 64 may be selected and positioned along an exterior surface of the hollow mandrel 68 for measuring a variety of strains. For example, the sensors 64 may be positioned to measure strains 74 resulting from axial loading, e.g. tensile and/or compressive strains. The sensor 64 also may be positioned to measure shear strains 76 resulting from twisting loads placed on monitoring module 46. Additionally, the sensors 64 may be arranged to measure radial oscillations 78 at the reduced wall thickness region 72 resulting from internal and/or external pressures acting on the monitoring module 46. For example, increased internal pressure within passage 70 relative to external pressure causes the reduced wall thickness region 72 to flex outwardly; and increased external pressure relative to internal pressure causes the reduced wall thickness region 72 to flex inwardly. These flexing movements, e.g. oscillating movements, can be measured and monitored by sensors 64 to infer an internal and/or external pressure via suitable processing of sensor data at, for example, downhole processor 66 and/or surface control system 24.

The sensors 64 may be strain sensors having a variety of types and/or configurations depending on the environment and the parameters of a given downhole operation. By way of example, the strain sensors 64 may comprise Wheatstone bridges, electric transducers, piezoelectric sensors, optical fibers, and/or other types of strain sensors. The strain gauges may be arranged in different orientations to measure strains in different directions. In some applications, the sensor 64 may comprise triplet strain sensors which measure strain in X, Y, Z directions.

Figure 4:
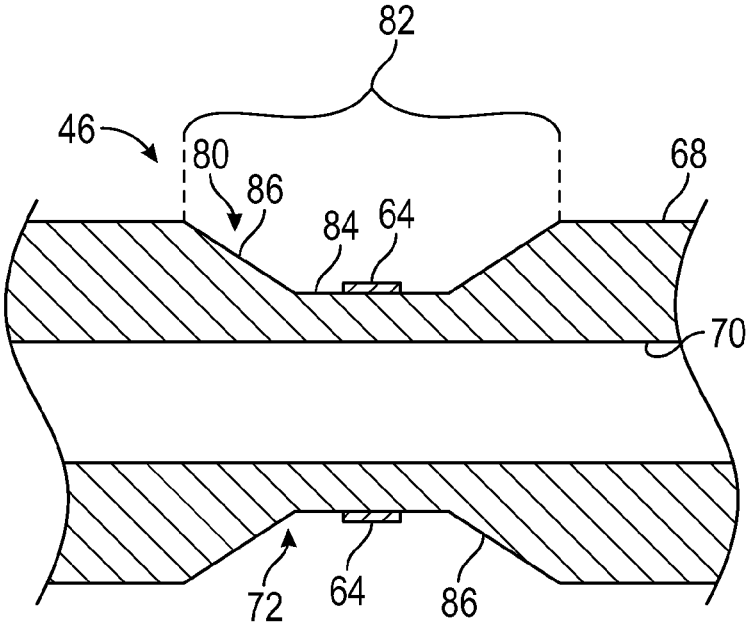
FIG. 4 is a cross-sectional view of an example of a monitoring module, according to an embodiment of the disclosure.

Referring generally to FIG. 4, the landing string monitoring module 46 (or completions monitoring module 48) may have a variety of configurations and may utilize hollow mandrel 68 as an integral bore mandrel supporting loading along the landing string 28 or other tubing string. The landing string monitoring module 46, may thus allow fluid to pass therethrough along internal passage 70 while also supporting compressive and tensile loads acting on, for example, the landing string, completion string, and/or completion installation string. In these types of embodiments, the mandrel 68 serves as a structural member for both fluid and load transmission, and also as a sensing location for oriented load sensing devices 64.

The hollow mandrel 68 may be constructed to form the reduced wall thickness region 72 by providing a reduced radius section or profile 80 along hollow mandrel 68. The reduced wall thickness region 72 provides for greater sensitivity within a measurement section or load sensing location 82 relative to a sensor arrangement positioned at the full profile, outer diameter of the hollow mandrel 68. The reduced radius section 80 is not limited to a single shape, and may have a variety of shapes which reduce the cross sectional area of the load sensing location 82 of hollow mandrel 68. In the example illustrated in FIG. 4, the hollow mandrel 68 is constructed such that the reduced wall thickness region 72 is formed by a recessed profile in the string monitoring module 46. The recessed profile has a flat bottom 84 bounded by flat, angled axial ends 86. As illustrated, the flat, angled axial ends 86 form a non-perpendicular, obtuse angle with respect to flat bottom 84 and the flat bottom 84 provides a surface to which sensors 64 may be mounted, e.g.

bonded or otherwise affixed. In the illustrated example, the hollow mandrel 68 is generally tubular in shape with a thinner wall thickness at the reduced wall thickness region 72 relative to the wall thickness of the remainder of the hollow mandrel 68.

At least one sensor and often a plurality of sensors 64 may be bonded to the hollow mandrel 68. By way of example, the sensors 64 may be bonded to an outer surface of the mandrel 68 and spaced about the circumference of at least a portion of the reduced radius section 80 along flat bottom 84. In the embodiment illustrated, the reduced radius section 80 extends about the entire circumference of hollow mandrel 68. Suitable bonding techniques may be implemented, including suitable glues, epoxies, other adhesives, and/or other suitable bonding materials and/or processes.

Figure 5:
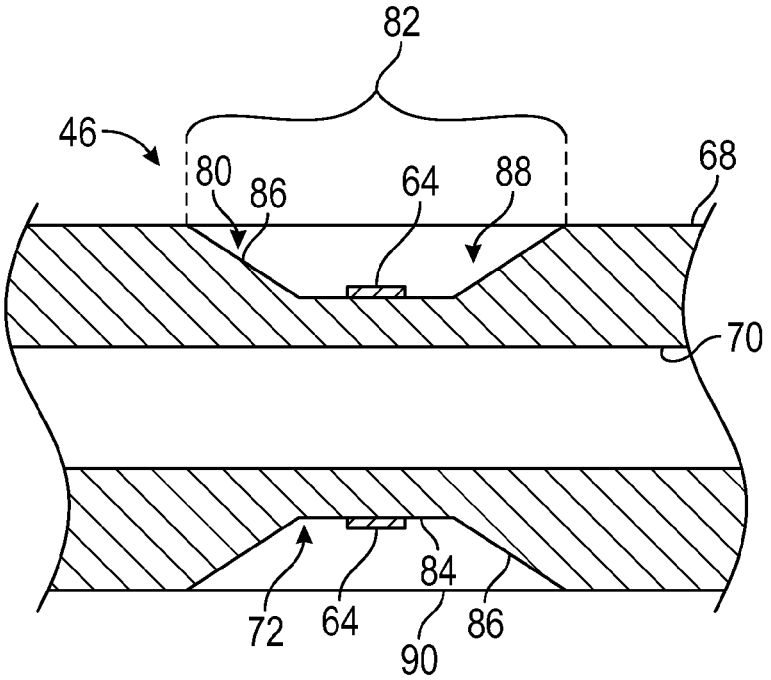
FIG. 5 is a cross-sectional view of another example of a monitoring module, according to an embodiment of the disclosure.

Referring generally to FIG. 5, another embodiment of monitoring module 46/48 is illustrated in which a load sensing chamber 88 is provided. The load sensing chamber 88 may be created by providing a cover 90, e.g. a sleeve, over the reduced radius section 80 of the mandrel 68. The sleeve 90 may be welded or otherwise coupled to the mandrel 68 to provide a water and air tight sealed chamber 88. In some embodiments, the load sensing chamber 88 may be filled with oil, while in other embodiments the chamber is not oil filled. Oil may serve to protect electrically sensitive components by providing a stable controlled environment in which they are housed. In some embodiments, the load sensing chamber 88 may be pressure balanced with the surrounding environment. The pressure in sensing chamber 88 may be referenced to either internal bore pressure or external tool pressure to aid in reducing errors of measurements within sensing chamber 88 while also reducing the pressure differential across the reduced wall thickness region 72 of mandrel 68.

Figure 6:
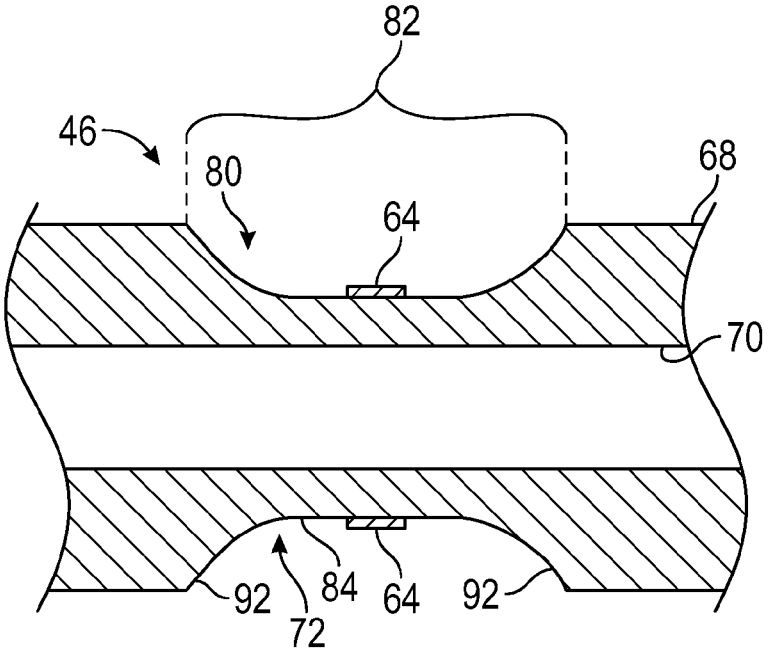
FIG. 6 is a cross-sectional view of another example of a monitoring module, according to an embodiment of the disclosure.

Referring generally to FIG. 6, another embodiment is illustrated in which the reduced radius section 80 has a different profile. In this example, the reduced wall thickness region 72 is again formed as reduced radius section 80. However, the reduced radius section 80 has a recessed profile with flat bottom 84 bounded by curved, axial ends 92. The curved, axial ends 92 may be oriented to smoothly join flat bottom 84 in a manner which eliminates angles that can be susceptible to stress concentrations in some applications. The embodiment of monitoring module 46/48 illustrated in FIG. 6 also may be combined with sleeve 96 or other suitable cover to form load sensing chamber 88.

In a variety of applications, the hollow mandrel 68 may be used as a bore pressure or external pressure sensor. As pressure in either the bore or annulus changes, the inner walls of reduced wall thickness region 72 undergo a localized deflection (see arrow 78 in FIG. 3) which acts on the corresponding sensing element(s) 64. This localized deflection can be correlated to the pressure in either the bore (passage 70) or the annulus of the landing or completion string. This method for sensing the pressure in either or both the bore and annulus is non-intrusive and thus does not disturb fluid flow along internal passage 70.

In addition to load and pressure sensing, the sensors 64 may be bonded along the reduced wall thickness region 72 for use in detecting changes in the surrounding temperature. Thermal effects result in localized deflections along the reduced wall thickness region 72 of the mandrel 68 and those localized deflections may be detected and monitored by the sensor 64. This information may be used to determine the local temperature of the fluid environment near the sensing elements 64. Additionally, this information can be used to remove potential sources of measurement error from thermal changes within the measured fluids. In other words, temperature determined based on the localized deflections of the mandrel 68 may be used to gain a better understanding of the fluid present at or near the location of the mandrel 68 by removing thermal induced error from fluid measurements.

The load sensing mandrel 68 also may be used to measure the bending load that the landing string 28, completion string 50, or other tubular string experiences during operations. By orienting the load sensing devices (e.g., sensors 64) around the circumference of the reduced wall thickness region 72, the direction and magnitude of bending can be measured. Bending measurements may be used to more accurately detect the fatigue that is experience within load carrying components of the subsea landing string 28 and/or completions strings 50. The data collected by sensors 64 may be processed to facilitate decision-making regarding servicing of components and/or other actions regarding the subsea operation.

With respect to at least some embodiments described herein, desired correlations may be determined by using empirical data and/or known characteristics of the sensors 64. The empirical data may be acquired through testing prior to deployment of a well string with the mandrel 46/48 installed. For example, tests may be run with the mandrel 46/48 under certain known conditions and test measurements may be taken. Those test measurements may subsequently be used to correlate data provided from a deployed mandrel 46/48 to the conditions that the mandrel was exposed to during testing, thereby correlating the data to a desired parameter. Furthermore, the data acquired from a deployed mandrel 46/48 may be stored and an aggregate fatigue measurement may be determined. For example, the various strains sensed on the mandrel 46/48 may be input into the total stress and/or fatigue determination for the mandrel 68 and/or other components within the well string.

In some embodiments, the sensors 64 may take the form of strain gauges. The strain gauges may be resistive or capacitive strain gauges, for example, or a combination of various types of strain gauges. Depending on the application, the strain gauges may be arranged in a suitable configuration, e.g. arranged as a quarter bridge, a half bridge, and/or a full bridge Wheatstone bridge. Furthermore, the strain gauges may be arranged in one more orientations on the hollow mandrel 68 to take advantage of directional sensitivities that may be exhibited by the gauges. For example, two otherwise identical gauges 64 may be bonded to the mandrel 68 with a first gauges 64 having a first orientation and a second gauge 64 having a second orientation offset from the orientation of the first (e.g., rotated 30, 45, 60, 75, 90, 180 degrees, or other suitable offset orientation).

By way of further example, at least some of the sensors 64 may be piezoelectric transducers. The piezoelectric sensor 64 may comprise ceramic or crystal which produces electrical output when compressed, flexed, stretched or otherwise subjected to a force. The piezoelectric sensors also may be arranged in one more orientations on the hollow mandrel 68 to take advantage of directional sensitivities that may be exhibited by the sensors. For example, two otherwise identical sensors may be bonded to the mandrel 68 with a first sensor 64 having a first orientation and a second sensor 64 having a second orientation offset from the orientation of the first (e.g., rotated 30, 45, 60, 75, 90, 180 degrees, or other suitable offset orientation).

Different types of sensors 64 may be implemented alone or in combination. For example, at least one of the sensors 64 may be an accelerometer, a device that is used to provide an indication of the acceleration of the monitoring module 46/48 along a predefined axis. In this manner, one or more of these accelerometer sensors 64 may be used to provide electrical indications which the processor 66 uses to determine a vibration, for example, of the monitoring module 46/48. This vibration may be attributable to the interaction between the marine riser string 30 and the landing string 28 during the deployment or retrieval of the landing string 28. The telemetry circuitry 62, in turn, may communicate an indication of this detected vibration to the circuitry 26 of control system 24 on platform 22. The vibration that is detected by the sensors 64 may be useful for monitoring the running and/or the retrieval of the landing string 28, e.g. to ensure maximum running/retrieval speed without incurring damaging vibrations to the landing string 28.

In some embodiments, at least one of the sensors 64 may comprise an orientation sensor, such as a gyroscope, which provides an indication of the orientation of the monitoring module 46/48 or tubing string segment, e.g. the segment of the landing string 28 containing the module 46. The indication of orientation may be provided to the processor 66 in relation to some subsea feature. For example, the sensor 64 may communicate an orientation of the module 46 with respect to the marine riser 30, BOP 36 or well tree 38. This communication may occur in real time as the monitoring module 46 travels through the marine riser string 30 from the platform 22 to the subsea equipment and as the monitoring module 46 travels through the BOP 36 and well tree 38.

The orientation sensor 64 may, for example, communicate an indication of an azimuth, or angle of inclination, between the module 46 and a reference axis that extends along the central passageway of the subsea well tree 38 and BOP 36. In these embodiments, the orientation sensor 64 may be a gyroscope that provides an indication of the inclination of the monitoring module 46 or another part of the landing string 28 in which the orientation sensor 64 is located. Due to the potentially small clearances that exist between the assembly 44 (see FIG. 1) and the BOP 36/well tree 38, relatively small angles of inclination may be tolerated to prevent the string 28 from becoming lodged inside the BOP 36/well tree 38. The measured angle permits an operator at the surface platform 22 to determine whether the landing string 28 can be retrieved from the well without being stuck in the BOP 36/well tree 38. Thus, with the knowledge of the azimuth of the end of the landing string 28, the inclination of the string 28 may be adjusted before the landing string 28 is retrieved (or further retrieved) from the BOP 36/well tree 38 or inserted (or further inserted) into the BOP 36/well tree 38.

Furthermore, the orientation sensor 64 may sense additional orientation-related characteristics, e.g. the angular position of the lower end of the landing string 28 about the string's longitudinal axis. This angular position may be sensed near the lower end of the landing string 28. The ability to measure the angular position of the well string may be desirable due to the inability to accurately determine the angular position based on measurements taken from a point near the platform 22. Due to the frictional forces that are exerted on the landing string 28, an angular displacement of the landing string 28 near or at the surface platform 22 may produce a vastly different displacement near the subsea well. Thus, it is difficult if not impossible to detect the effect of a particular angular displacement at the platform 22 with respect to the resultant angular displacement at the subsea well. The orientation sensor 64, however, may be used to provide a more direct measurement which can then be used for controlling the angular position of the landing string 28 inside the BOP 36 and well tree 38. Knowledge of the angular position of the end of the landing string 28 also may be helpful for guiding the landing string 28 as the end of the string rotates inside a helical groove or other feature inside the well tree 38.

Orientation and/or acceleration parameters may be used in conjunction with parameters determined based on the localized deflection of the hollow mandrel 68 discussed above to gain a better understanding of the conditions to which the subsea landing string 28 is exposed. Furthermore, the parameters may be useful in understanding the source, magnitude, and direction of stresses applied to the subsea landing string 28 (or other tubular strings) while the string is deployed.

Depending on the application, the well system 20 may have a variety of configurations and/or components. Similarly, the monitoring modules may have various configurations for use with many types of tubing strings in a variety of subsea applications. A single sensor or a plurality of sensors may be used to obtain data at an individual location or multiple locations. Additionally, the sensor or sensors may comprise strain gauges and/or other types of sensors to facilitate the accumulation of desired data. The data also may be processed according to a variety of computer models and/or according to various algorithms to determine the estimates of fatigue life for a given type of component.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system, comprising:

a tubular string extending from a surface platform toward a sea floor, the string having an upper end and a lower remote end; and a string monitoring module coupled into the tubular string, the string monitoring module comprising:

a hollow mandrel having a reduced wall thickness region encircling the hollow mandrel to concentrate strain in the reduced wall thickness region;

a plurality of strain sensors spaced about the circumference of the reduced wall thickness region, wherein an interior surface of the hollow mandrel is configured to be contacted by fluid flowing through an internal passage of the hollow mandrel at a point that is axially-adjacent to at least one of the plurality of strain sensors and wherein the plurality of strain sensors is arranged to sense a localized deflection of the hollow mandrel indicative of internal pressure or external pressure acting on the reduced wall thickness region; and a communication telemetry circuit configured to communicate data signals from the string monitoring module to a control system located on the surface platform.

2. The system as recited in claim 1, wherein the at least one of the plurality of strain sensors is located in a load sensing chamber defined at least in part by a sleeve covering the reduced wall thickness region.

3. The system as recited in claim 2, wherein the load sensing chamber is filled with oil.

4. The system as recited in claim 1, wherein at least one of the plurality of strain sensors is bonded to the exterior surface of the hollow mandrel.

5. The system as recited in claim 1, wherein the string monitoring module is a structural member for both fluid and load transmission.

6. The system as recited in claim 1, wherein at least one of the plurality of strain sensors is an accelerometer.

7. The system as recited in claim 1, wherein at least one of the plurality of strain sensors is a gyroscope.

8. The system as recited in claim 1, wherein at least one of the plurality of strain sensors is a piezoelectric transducer.

9. The system as recited in claim 1, wherein the string monitoring module further comprises at least one sensor coupled to an exterior surface of the hollow mandrel at the reduced wall thickness region to monitor temperature, wherein temperature data from the at least one sensor to monitor temperature is used to remove thermal-induced error from strain data from the at least one sensor to monitor strain.

10. The system as recited in claim 1, wherein the plurality of strain sensors is configured to measure a direction and a magnitude of bending of the hollow mandrel.

11. The system as recited in claim 1, wherein the plurality of strain sensors is arranged to sense radial oscillations of the hollow mandrel indicative of internal pressure or external pressure acting on the reduced wall thickness region.

12. A method, comprising:

coupling a monitoring module in a tubing string, wherein the monitoring module comprises an internal passage and a reduced wall thickness region in which at least one sensor is mounted;

running the tubing string in-hole with the monitoring module, wherein an interior surface of the monitoring module is configured to be contacted by fluid flowing through the internal passage at a point that is axially-adjacent to the at least one sensor;

sensing physical characteristics of the monitoring module at the reduced wall thickness region by determining pressure by sensing a localized deflection at the reduced wall thickness region using the at least one sensor; and communicating data signals from the monitoring module to a control system utilizing communication telemetry circuit;

correlating the sensed physical characteristics to at least one of a load on the tubing string or a downhole condition utilizing the control system.

13. The method as recited in claim 12, further comprising providing the reduced wall thickness region in the form of a recessed profile extending around the circumference of the monitoring module.

14. The method as recited in claim 12, wherein the communication telemetry circuit communicates data signals to the control system via a wireless communication medium.

* * * * *